US007453339B2

(12) United States Patent
Fork et al.

(10) Patent No.: US 7,453,339 B2
(45) Date of Patent: Nov. 18, 2008

(54) ELECTROMECHANICAL SWITCH

(75) Inventors: David K. Fork, Los Altos, CA (US); Thomas Hantschel, Wevelgem (BE); Koenraad F. Van Schuylenbergh, Sunnyvale, CA (US); Jeng Ping Lu, San Jose, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 179 days.

(21) Appl. No.: 11/292,421

(22) Filed: Dec. 2, 2005

(65) Prior Publication Data

US 2007/0126536 A1 Jun. 7, 2007

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS 5,463,233 A * 10/1995 Norling ..... 257/254
6,057,520 A * 5/2000 Goodwin-Johansson .... 200/181
6,127,908 A * 10/2000 Bozler et al. ..... 333/246
6,191,671 B1 * 2/2001 Schlaak et al. ..... 335/78
6,229,683 B1 * 5/2001 Goodwin-Johansson .... 361/233
6,633,212 B1 * 10/2003 Ruan et al. ..... 335/78
6,731,492 B2 * 5/2004 Goodwin-Johansson .... 361/233
7,053,737 B2 * 5/2006 Schwartz et al. ..... 335/78

OTHER PUBLICATIONS

Elliott R. Brown, "RF-MEMS Switches for Reconfigurable Integrated Circuits," *IEEE Trans. Microwave Theory & Techniques*, vol. 46, No. 11, pp. 1868-1880, Nov. 1998.

* cited by examiner

*Primary Examiner*—Elvin G Enad
*Assistant Examiner*—Bernard Rojas
(74) *Attorney, Agent, or Firm*—Fay Sharpe LLP

(57) ABSTRACT

In one aspect, an electromechanical switching device is illustrated. The electromechanical switching device includes a relay with at least one first conductive portion, at least one second conductive portion, and at least one actuation component that moves the at least one first conductive portion and the at least one second conductive portion into and out of conductive contact. The at least one first conductive portion includes a conductive stationary end coupled to a substrate and a conductive free-floating end. The at least one actuation component includes an actuation stationary end coupled to the substrate and an actuation free-floating end. The actuation free floating end, when the at least one actuation component is not energized, curls, which curls the conductive free floating end into or out of conductive contact with the at least one second conductive portion.

4 Claims, 3 Drawing Sheets

ELECTROMECHANICAL SWITCH

BACKGROUND

The following generally relates to switching devices. More particularly, it is directed towards electromechanical switches such as micro-machined electromechanical relays. However, other types of switches are also contemplated.

A relay generally is a switch that opens and closes under control of an electrical circuit. Traditional relays typically employ an electromagnet that opens or closes one or more sets of contacts. When a current flows through the coil, the resulting magnetic field attracts an armature that is mechanically linked to a moving contact. The movement either makes or breaks a connection with a fixed contact. When the current is switched off, the armature is usually returned to its resting position. The contacts within a relay may be manufactured as normally-open, normally-closed, or change-over (or dual throw) contacts.

Microelectromechanical Systems (MEMS) technology has been leveraged to render micro-machined relays with micrometer size mechanical structures. Such relays can range in size from a micrometer to a millimeter. MEMS based relays have become integral components in technologies involving satellites, aircraft and automobiles and are used in applications such as radar systems for collision avoidance, airborne early warning, tactical radars, and phased array systems.

In many instances, it is difficult to manufacture a micro-machined relay without having one or more actuation electrodes create a capacitive short for high frequency RF signals. In such instances, nearby electrodes drain power, even when they are not touching. Thus, there is a need for improved micro-machined relays that mitigate creation of capacitive shorts with the actuation electrodes.

BRIEF DESCRIPTION

In one aspect, an electromechanical switching device is illustrated. The electromechanical switching device includes a relay with at least one first conductive portion, at least one second conductive portion, and at least one actuation component that moves the at least one first conductive portion and the at least one second conductive portion into and out of conductive contact. The at least one first conductive portion includes a conductive stationary end coupled to a substrate and a conductive free-floating end. The at least one actuation component includes an actuation stationary end coupled to the substrate and an actuation free-floating end. The actuation free-floating end, when the at least one actuation component is not energized, curls, which curls the conductive free-floating end into or out of conductive contact with the at least one second conductive portion.

DETAILED DESCRIPTION

Figure 1:
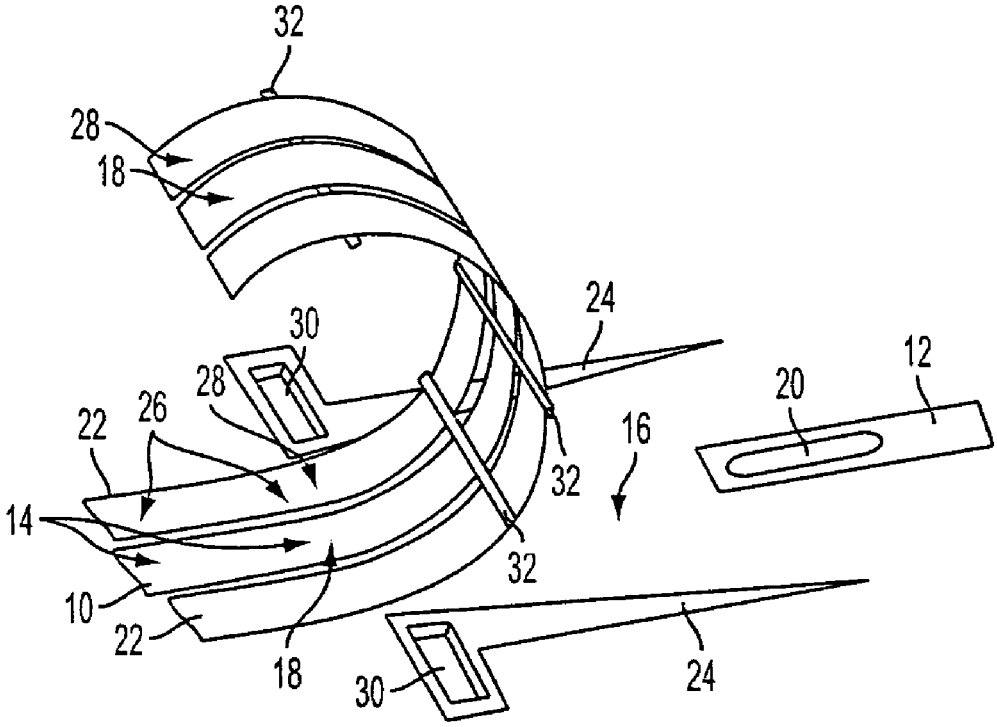
FIG. 1 illustrates a portion of an exemplary normally open electromechanical relay having a spring configuration with a less than 90 degree release angle.

FIG. 1 illustrates a portion of an exemplary electromechanical relay having a spring configuration with a less than 90 degree release angle. Such relay may be fabricated using MEMS and/or other technology to render a relatively minute micro-machined relay. The relay can also be enclosed in a hermetically sealed package in order to protect the structures from ambient effects. Suitable materials for producing the relay include, but are not limited to, silicon, polymers, and/or various metals (e.g., copper, silver, gold, alloys, etc.), including stressed metals. Suitable techniques for producing the relay include, but are not limited to, surface micromachining.

As depicted, the relay is normally open. However, the relay can be fabricated as a normally closed switch (as described in connection with FIG. 2 below), as a change-over switch (as described in connection with FIG. 3 below), or otherwise. In addition, the relay is illustrated in FIG. 1 as a single pole, single throw (SPST) switch (and also in FIG. 2 below), but it can also be fabricated as a single pole, double throw (SPDT) (as described in connection with FIG. 3 below), a multi pole, single throw (e.g., a double pole, single throw, a triple throw, single pole, etc.), a multi pole, double throw (e.g., a double pole, double throw, etc.), etc. switch. The relay can be also be fabricated in conjunction with other micro-machined components such as coils, capacitors, antennae, resonators, filters, oscillators, VCOs, etc.

The switch mechanism is formed from a first electrode 10 and a second electrode 12. The switch is closed when the first and the second electrodes 10 and 12 are in conductive contact, and the switch is open otherwise. As depicted, at least a portion 14 of the first electrode 10 is coupled to a substrate 16, while another portion 18 of the first electrode 10 is free-floating. The second electrode 12 typically is formed within and/or on the substrate 16. The substrate 16 can be formed from various materials such as, for example, silicon (Si), gallium arsenide (GaAs), Germanium (Ge), ceramic (e.g., thick-film, thin-film alumina, low-temperature co-fired ceramic, etc.), etc., with or without other components).

The first electrode 10 is associated with an input (not shown) of the relay that is sourced with a signal such as an analog and/or digital voltage, an analog and/or digital current, power, a radio frequency (RF) signal, etc. When the relay is in an "off," "open," "not activated," "not energized," etc. state, the first electrode 10 is separated from the second electrode 12 such that the signal is not conveyed from the first electrode 10 to the second electrode 12. In an "on," "closed," "activated," "energized," etc. state, the first electrode 10 and the second electrode 12 are in conductive contact and the signal is conveyed from the first electrode 10 to the second electrode 12. The signal can then be distributed from the relay via the second electrode 12 through an output (not shown) of the relay.

In one instance, the first electrode 10 is a spring cantilever or the like that curls and/or moves away from the second electrode 12 when in the "off" state. When in the "on" state, the spring cantilever uncurls or substantially straightens and moves into conductive contact with the second electrode 12. The curling of the first electrode 10 is at least partially due to internal stresses that are built into the first electrode 10 during fabrication. When the first electrode 10 curls away from the second electrode 12, the capacitance between the first electrode 10 and the second electrode 12 becomes relatively small, which minimizes parasitic signal transmission in the "off" state. In the "on" state, the first electrode 10 is pulled towards and into physical and/or capacitive contact with the second electrode 12, which closes the relay for signal transmission.

In some instances, one or more members 20 are formed within the second electrode 12 of the switch to facilitate transmission of the signal when the switch is closed. The member 20 can be a "bump" of the same material or a different material that is incorporated into or onto the second electrode 12 to improve contact. Contact can be additionally or alternatively improved by applying a passivating material that resists oxidation to the surfaces of the second electrode 12 and/or the "bump." Alternatively or additionally, the member 20 can be incorporated into or onto the first electrode 10 such that it comes into conductive contact with the second electrode 12 when the relay is energized. The conductive contact between the first and second electrodes 10 and 12 can be metal-to-metal contact and/or capacitive coupling due to the close proximity and area overlap of the first and second electrodes 10 and 12.

The actuation mechanism includes at least one actuation spring 22, each with a corresponding actuation electrode 24. For explanatory purposes, two actuation springs 22 and two corresponding actuation electrodes 24 are illustrated. However, in other instances, more than two actuation springs 22 and/or more than two actuation electrodes 24 are used. As depicted, each actuation spring 22 may be formed on the substrate 16 such that a portion 26 is coupled to the substrate 16 and another portion 28 is free floating. Each actuation spring 22 may be formed within and/or on the substrate 16. As depicted, each actuation electrode 24 is tapered. However, this configuration is not limiting and the actuation electrodes 24 can be variously shaped. For example, in other embodiments plain actuation electrodes underneath ground strips can be used instead of the illustrated tapered electrodes positioned aside the ground strips.

The actuation electrode 24 is optionally associated with an interconnect 30. When energized, the free-flowing portion 28 of each actuation spring 22 is drawn to the associated actuation electrode 24. Such drawing may include uncurling of the free-flowing portion 28. In many instances, the free-flowing portion 28 is electrostatically drawn to the actuation electrode 24. When not activated, the free-flowing portion 28 of each actuation spring 22 curls away from the associated actuation electrode 24. The curling of each actuation spring 22 is at least partially due to internal stresses that are built into each actuation spring 22 during fabrication.

In the illustrated aspect, the switch mechanism is separated and/or substantially isolated from the actuation mechanism. One benefit of such configuration is that it can facilitate mitigating the formation of a capacitive short through the actuation mechanism. However, at least a portion of the actuation spring 22 is coupled to the first electrode 10 of the switch via a mechanical coupling 32. For instance and as depicted, the free-floating portions 18 and 28 of the first electrode 10 and the actuation spring 22, respectively, can be coupled via the coupling 32. Such coupling can extend to the non-free floating portions of the first electrode 10 and/or the actuation spring 22. In one instance, the free-floating portions 18 and 28 of the first electrode 10 and the actuation spring 22 are coupled mechanically through a dielectric tether. However, it is to be appreciated that other coupling techniques are also contemplated. For instance, rather than thin strips as shown, the tethers can take the form of an extended dielectric sheet. In another instance, the tethers can be a laminate. Staples, or other types of anchors, can be formed on the tethers to help hold them in place and resist de-lamination.

Through the coupling 32, the free-floating portion 18 of the electrode 10 is slaved such that it moves in substantial unison with the free-floating portion 28 of the actuation spring 22. Thus, when the free-floating portion 28 of the actuation spring 22 curls, the free-floating portion 18 of the first electrode 10 curls in substantial unison with it, and when the free-floating portion 28 of the actuation spring 22 uncurls, or substantially straightens, the free-floating portion 18 of the first electrode 10 uncurls, or substantially straightens with it. The relay may operate as a simple on-off device, snapping down at a specified voltage. In this configuration, each actuation spring 22 may also serve as a (AC) ground surrounding the line carrying the signal. If desired, the relay can be configured to produce continuous actuation. In this type of device, variable coupling can be achieved, making the relay into a variable attenuator.

Chemical mechanical polishing (CMP) or other techniques can be used to flatten a surface containing the first electrode 10 and/or the spring 22 prior to fabrication. This facilitates reliability and/or performance issues that can develop if the first electrode 10 and/or the spring 22 are fabricated over excessive topography. Resistive losses can be reduced by utilizing spring alloys with high conductance, or by adding metal to increase the conductance. To lower-the actuation voltage, alloys can be selected with low modulus and the dimensions can be modified to lower the spring constant. Dry release, such as using XeF2, can be utilized in order to release soft springs that would be damaged by surface tension forces, or succumb to stiction during drying. The dielectric properties of the materials around the released and unreleased portions of the device can be designed to produce controlled impedances along the device in its states of operation.

Figure 2:
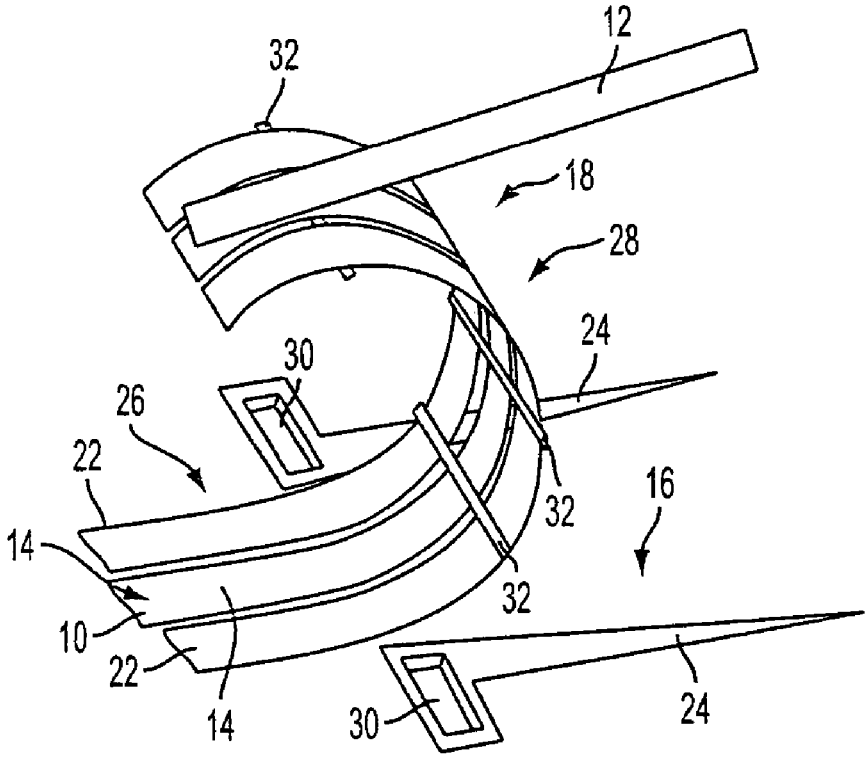
FIG. 2 illustrates a portion of an exemplary normally closed electromechanical relay having a spring configuration with a less than 90 degree release angle.

FIG. 2 illustrates a normally closed configuration of the relay described in FIG. 1. In this embodiment, the switch mechanism is still separated and substantially isolated from and coupled to the actuation mechanism through the coupling 32. In addition, the free-floating portion 18 of the electrode 10 is still slaved to the free-floating portion 28 of the actuation spring 22 such that the free-floating portion 18 of the electrode 10 moves with the free-floating portion 28 of the actuation spring 22. As a result, when the free-floating portion 28 of the actuation spring 22 curls, the free-floating portion 18 of the first electrode 10 curls in substantial unison with it, and when the free-floating portion 28 of the actuation spring 22 uncurls, or substantially straightens, the free-floating portion 18 of the first electrode 10 uncurls, or substantially straightens with it.

One difference between the embodiments illustrated in FIGS. 1 and 2 is the relative position of the first and second electrodes 10 and 12 with respect to each other. In this example, when the relay is in an "off" state, the free-floating portion 28 of the actuation spring 22 curls, which curls the free-floating portion 18 of the first electrode 10 to form a conductive contact between the first electrode and the second electrode 12. The signal can then be conveyed from the first electrode 10 to the second electrode 12. When the rely is in an "on" state, the free-floating portion 28 of the actuation spring 22 uncurls or substantially straightens, which uncurls the free-floating portion 18 of the first electrode 10, and the conductive contact between the first electrode 10 and the second electrode 12 is terminated, severed, broken, etc. In this state, the signal is not conveyed to the second electrode 12. As discussed above, the curling of the actuation spring 22 and/or the first electrode 10 is at least partially due to internal stresses that are created during fabrication.

When the first electrode 10 uncurls or straightens, the capacitance between the first electrode 10 and the second electrode 12 is relatively low, which minimizes parasitic signal transmission in the "off" state. In the "on" state, the first electrode 10 curls toward the second electrode 12 and physical and/or capacitive coupling between the first and second electrodes 10 and 12 facilitates transmission of the signal.

Figure 3:
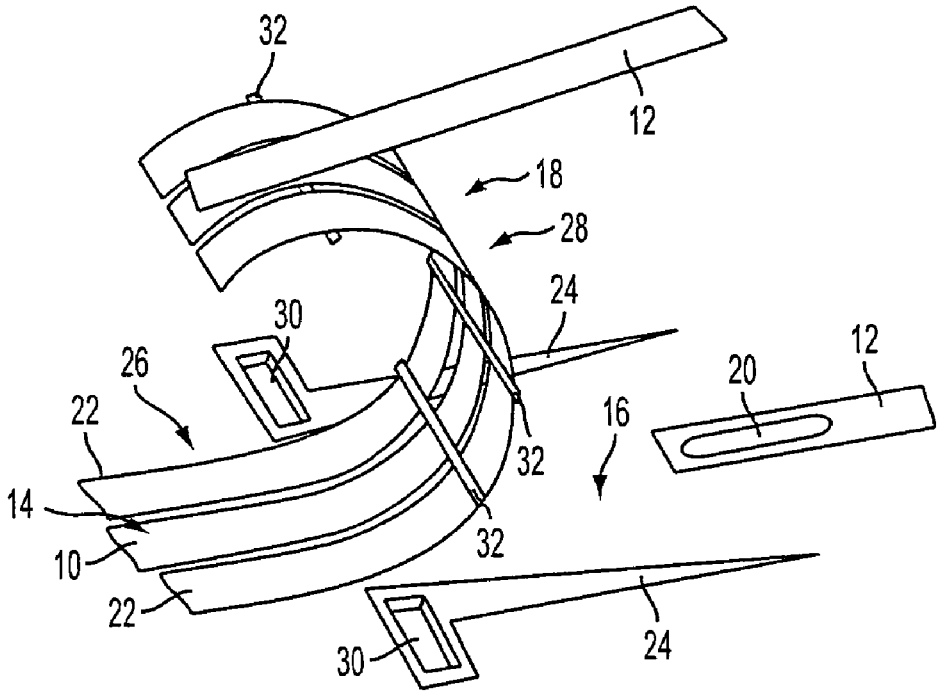
FIG. 3 illustrates a portion of an exemplary change-over electromechanical relay having a spring configuration with a less than 90 degree release angle.

FIG. 3 illustrates a change-over configuration of the relay described in FIG. 1. With this configuration, two second electrodes 12 are used. Typically, each of the second electrodes provides a path to a different circuit and the switch mechanism determines which path the signal is conveyed over by forming a conductive contact between the first electrode 10 and one of the two second electrodes 12. By way of example, in the "off" state, the free-floating portion 28 of the actuation spring 22 curls, which curls the free-floating portion 18 of the first electrode 10 to form a conductive contact between the first electrode 10 and one of the second electrodes 12. The signal can be conveyed from the first electrode 10 to the second electrode 12 that is in conductive contact with the first electrode. In the "on" state, the free-floating portion 28 of the actuation spring 22 uncurls or substantially straightens, which uncurls the free-floating portion 18 of the first electrode 10 to form a conductive contact between the first electrode 10 and the other the second electrodes 12. The signal can be conveyed from the first electrode 10 to the second electrode 12 that is in conductive contact with the first electrode. As discussed above, the curling of the actuation spring 22 and/or the first electrode 10 is at least partially due to internal stresses that are created during fabrication.

Figure 4:
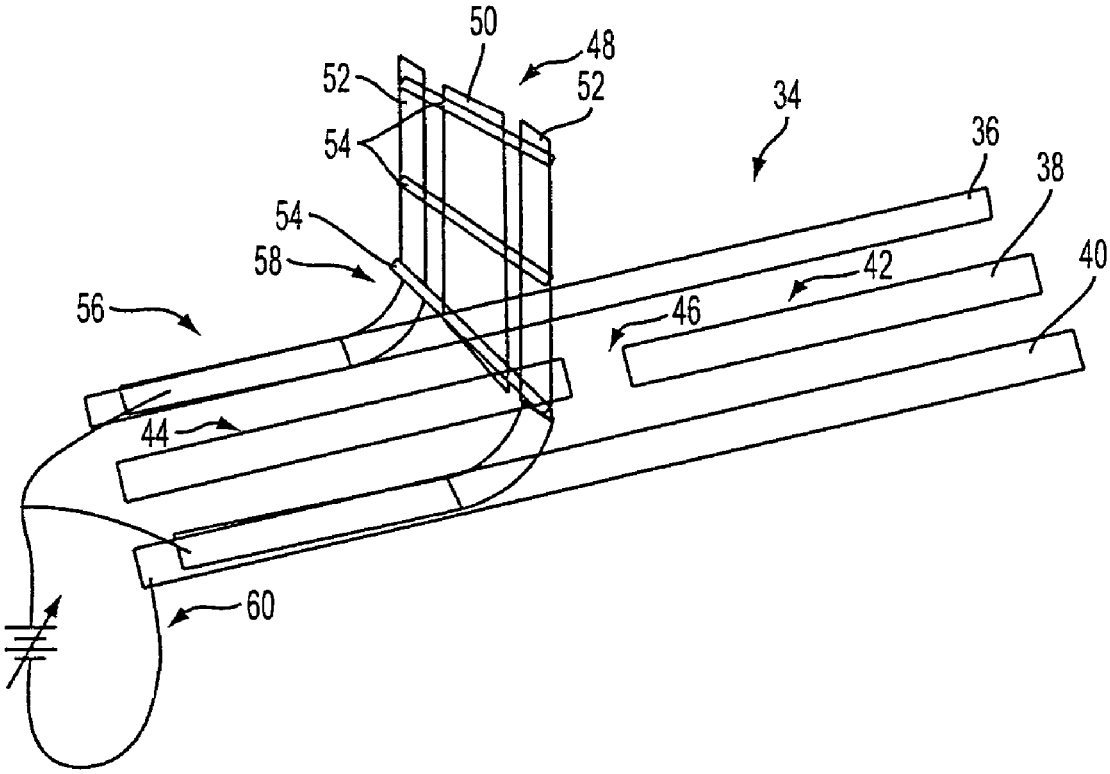
FIG. 4 illustrates a portion of an exemplary relay in which a flap mechanism is used to form a conductive path between two portions of a signal carrying electrode.

FIG. 4 illustrates a portion of a relay in which a flap mechanism is used to form a conductive path between two portions of a signal carrying electrode. This configuration includes a coplanar stripline waveguide 34 with three strips 36, 38, and 40. It is to be understood that the waveguide 34 can include more or less strips in other instances. The center strip 38 carries the signal and is partitioned into two separate portions 42 and 44 by a gap 46. The gap 46 prevents the signal from being transmitted from the portion 44 to the portion 42, or vice-versa, when the switch is "open." When the switch is "closed," the portions 42 and 44 are conductively joined through a movable flap 48 that closes the gap 46.

The flap 48 includes the switch mechanism that is separated and/or substantially isolated from an actuation mechanism. The switch mechanism includes a conductive member 50, which forms a metal-to-metal and/or capacitive coupling with both portions 42 and 44 of the strip 38 when closing the gap 46. The actuation mechanism includes at least one actuation member 52, although two actuation members 52 are illustrated. The at least one actuation member 52 is coupled to the conductive member 50 via a coupling 54 such that the conductive member 50 moves in substantial unison with the actuation member 52. The coupling 54 can be a dielectric tether, an extended dielectric sheet, a lamination, and/or other known connecting devices. Each actuation member 52 includes a stationary portion 56 that is mechanically coupled to and electrically isolated from one of the strips 36 and 40 of the waveguide 34. With two members 52, as shown, such coupling can be on the same side of the waveguide 34 relative to the gap 46. However, in other instance, the stationary couplings 52 can reside on opposite sides of the gap 46. Each actuation member 52 further includes a spring portion 58 that curls when not energized and uncurls when energized. An example of an energizing source is illustrated at 60.

When the relay is in an "off" state, or not energized, the actuation member 52 curls away from the waveguide 34 via the spring portion 58, which moves the conductive member 50 out of conductive contact with the strip 38 such that the signal is not transmitted through the relay. When the relay is in an "on" state, or energized, the actuation member 52 uncurls and moves the conductive member 50 into conductive contact with the portions 42 and 44 such that the signal is transmitted through the relay over the strip 38. As noted above, such curling is at least partially due to internal stresses that are created during fabrication. At least one of the strips 36-40, the member 50, the actuation member 52, the stationary portion 56, and the spring portion 58 can be copper and/or coated with copper, gold or other metal with low electrical resistance.

It is to be appreciated that the above described actuation system can also be used in combination with FIGS. 1-3. For example, with the systems illustrated in FIGS. 1-3 ground strips can run underneath actuation springs. The ground strips and the actuation springs are electrically isolated and actuation forces are created by applying a voltage between ground strips and the actuation springs.

Figure 5:
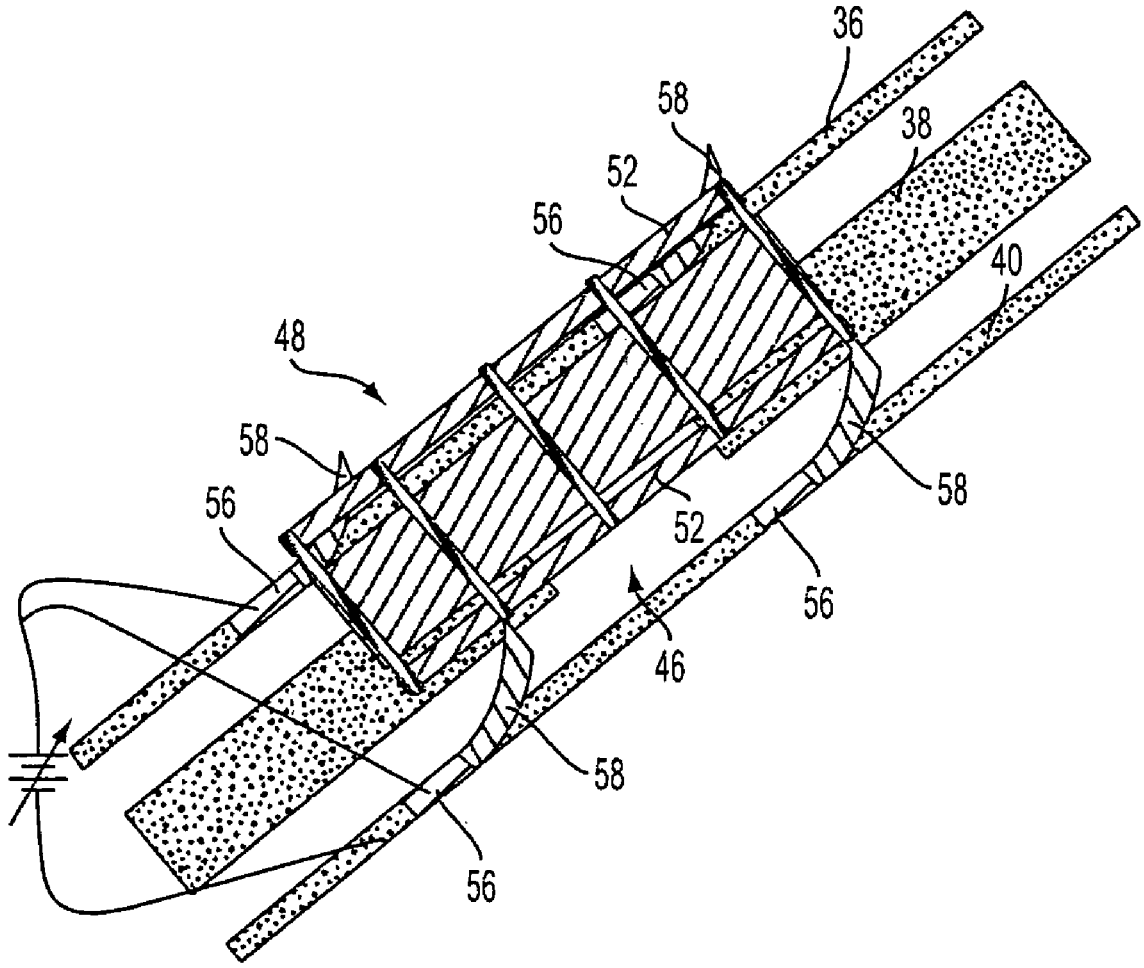
FIG. 5 illustrates a portion of a relay in which in which each actuation member is associated with two stationary portions and two spring portions.

FIG. 5 illustrates a portion of a relay in which in which each actuation member 52 coupled to the flap 48 is associated with two stationary portions 56 and two spring portions 58. The stationary portions 56 for each actuation member 52 are coupled to a similar strip (strip 36 or 40) on opposite sides of the gap 46. When the relay is in an "off" state, the spring portions 58 curl, which moves the flap 48 (including conductive member 50) away from the portions 42 and 44 of the strip 38 such that the signal is not transmitted through the relay. When the relay is in an "on" state, the spring portions 58 uncurl, which moves the flap 48 (including conductive member 50) into conductive contact with the portions 42 and 44 of the strip 38 such that the signal is transmitted through the relay.

It is to be understood that the examples illustrated herein are not limiting. Thus, although the illustrated relays only include a single signal carrier, other instances can include more than one signal carrier, including M signal carriers or switches, wherein M is an integer equal to or greater than one. In such instances, similar and/or different signals can be transmitted through the one or more switches. Still other instances may use one or more than two actuating mechanisms. Moreover, the relative position of the switch mechanism and the actuation mechanism can vary. As shown in the figures, the signal carrying electrode resides between two actuation springs. However, the signal carrying electrode(s) can be positioned on the outside of one of the actuation spring(s) or a single actuation spring may reside between two signal carrying electrodes.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An electromechanical relay, comprising:

a conductive conduit, including:

a first conductive portion, and a second conductive portion separated from the first portion by a gap;

an actuator adapted to be mechanically separate and electrically isolated from the first conductive portion, including:

at least one stationary leg, at least one mobile leg, and at least one spring portion disposed between the at least one stationary leg and the at least one mobile leg, the at least one spring portion moves the at least one mobile leg by curling when in an off state and uncurling when in an on state; and a conductive member, coupled to the at least one mobile leg by at least one dielectric tether that comprises thin strips of a dielectric material, the conductive member moves in substantial unison with the at least one mobile leg, the conductive member, when the relay is in an on state, moves, via the uncurling of the at least one spring portion, into conductive contact with the first and second conductive portions and creates a conductive path for conveying a signal through the relay.

2. The electromechanical relay as set forth in claim 1, wherein the conductive member, when the relay is in an off state, moves, via the curling of the at least one spring portion, out of conductive contact with the first and second conductive portions.

3. The electromechanical relay as set forth in claim 1, wherein the conductive conduit is a conductive strip of a coplanar stripline waveguide.

4. The electromechanical relay as set forth in claim 1, wherein the at least one stationary leg is mechanically coupled to at least one strip of a coplanar stripline waveguide.

* * * * *